US006283314B1

(12) United States Patent
Loguercio

(10) Patent No.: US 6,283,314 B1
(45) Date of Patent: Sep. 4, 2001

(54) FOLDABLE RACK

(76) Inventor: Paul Loguercio, 15 E. Putnam Ave., #217, Greenwich, CT (US) 06830-5424

( * ) Notice: Subject to any disclaimer, the term of this patent is extended or adjusted under 35 U.S.C. 154(b) by 0 days.

(21) Appl. No.: 09/416,655

(22) Filed: Oct. 12, 1999

(51) Int. Cl.[7] ..... A47F 5/00
(52) U.S. Cl. ..... 211/200; 211/202
(58) Field of Search ..... 211/195, 198, 211/200, 202

(56) References Cited

U.S. PATENT DOCUMENTS

| | | | | |
|---|---|---|---|---|
| 43,113 | * | 6/1864 | Harold . | |
| D. 261,350 | | 10/1981 | Koshiyama | D32/58 |
| D. 282,497 | | 2/1986 | Wiley | D32/58 |
| D. 321,423 | | 11/1991 | Ohm | D32/58 |
| D. 322,698 | | 12/1991 | Cassel | D32/58 |
| D. 357,777 | | 4/1995 | Bray | D32/58 |
| 630,150 | * | 8/1899 | White . | |
| 716,393 | * | 12/1902 | Downing . | |
| 1,109,275 | * | 9/1914 | Andrews . | |
| 1,594,415 | * | 8/1926 | Kalgren . | |
| 1,628,936 | * | 5/1927 | Turner . | |
| 4,131,205 | | 12/1978 | Malecki | 211/200 |
| 4,297,795 | | 11/1981 | Licari | 34/239 |
| 4,807,766 | | 2/1989 | Compagnucci | 211/198 |
| 4,828,123 | | 5/1989 | Basore | 211/202 |
| 5,044,507 | | 9/1991 | Shulyak | 211/203 |
| 5,213,221 | | 5/1993 | Raye, Sr. | 211/195 |
| 5,219,080 | | 6/1993 | Reyes | 211/123 |
| 5,492,237 | | 2/1996 | Chang | 211/202 |

FOREIGN PATENT DOCUMENTS

| | | | | |
|---|---|---|---|---|
| 6419 | * | 1/1909 | (GB) | 211/202 |

* cited by examiner

*Primary Examiner*—Robert W. Gibson, Jr.
(74) *Attorney, Agent, or Firm*—St. Onge Steward Johnston & Reens LLC

(57) ABSTRACT

An expandable structure adapted to convert from a collapsed position to an expanded position, wherein a plurality of parallel rods are mounted to pivotally interconnected links, each of which has a plurality of bores asymmetrically spaced from one another. The structure in its collapsed position is generally flat and can be conveniently stored. The structure can be expanded into an arch-shaped structure. The structure can be used as a portable drying rack, or may be used in other product applications.

16 Claims, 6 Drawing Sheets

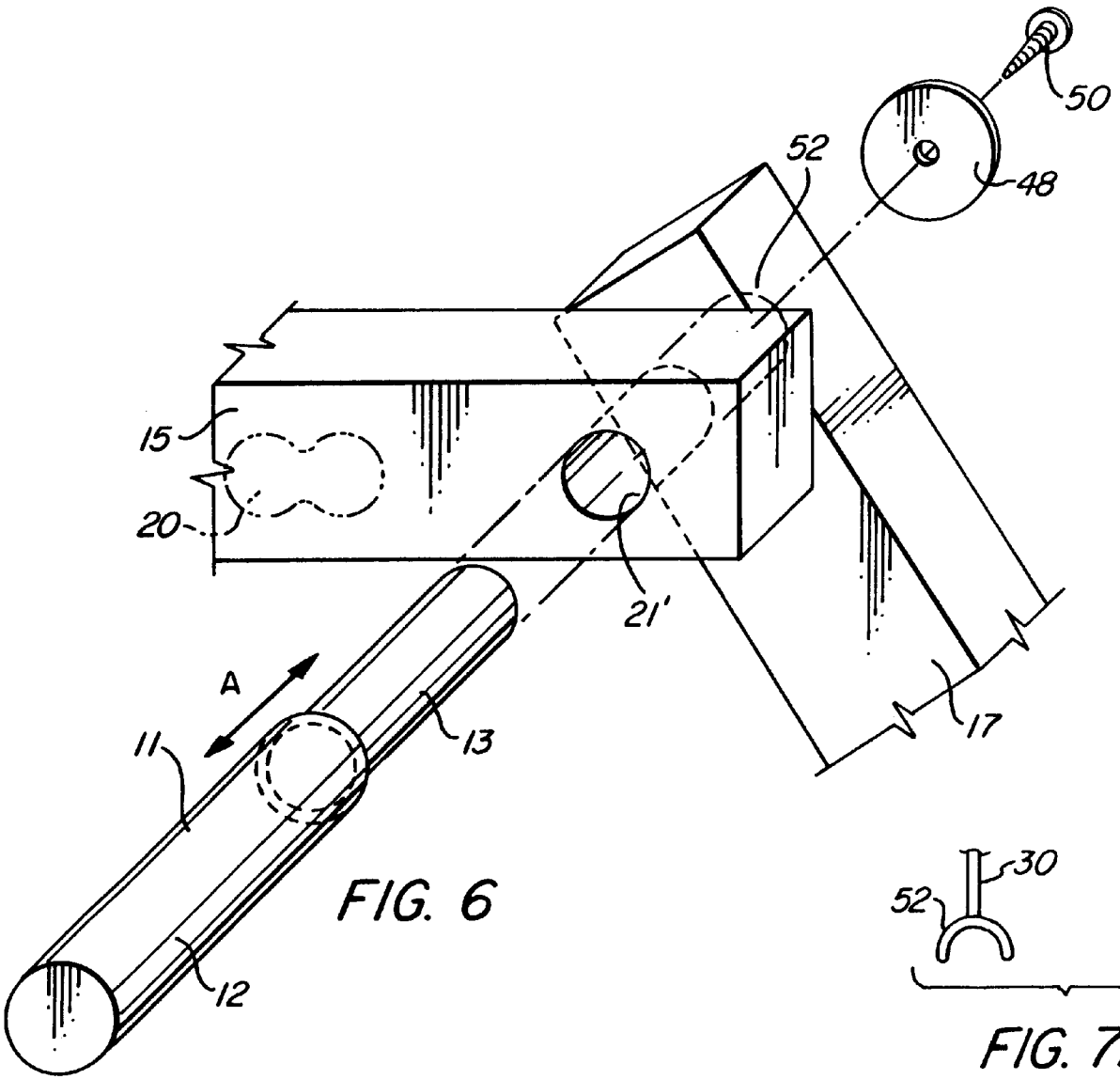
FIG. 6
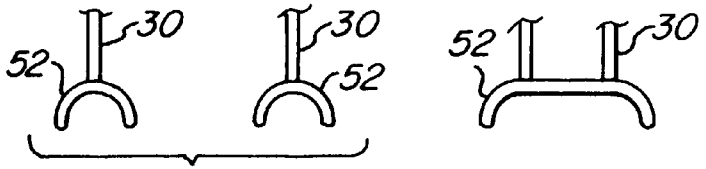
FIG. 7A
FIG. 7B

FOLDABLE RACK

FIELD OF THE INVENTION

The present invention relates to expandable structures having a plurality of hanging bars that extend between opposite collapsible frames. Particularly, the present invention relates to foldable racks for hanging articles such as wet clothing from the hanging bars so that they may be dried.

BACKGROUND OF THE INVENTION

Foldable drying racks which can be set up outdoors or indoors, such as in a kitchen or in a bathtub of a dwelling, and then be collapsed for transport or storage, have been known for many years. The structure of such drying racks generally comprises a rectangular rack portion,-which is held horizontally by legs at each end of the rack portion. The legs at one end typically are two legs crossing each other and hinged together to form an "X" shape, one upper end of which is affixed to the rack portion, and one end which is detachable from the rack portion, to allow the rack to be folded. A limitation of such structures is that they provide only a limited capacity for the "footprint" they occupy when expanded. An example of this basic design is shown in Cassel, U.S. Design Pat. No. 322,698. Moreover, many of these structures are rickety and may collapse if overloaded with wet clothing. A variant of this basic design is disclosed in U.S. Pat. No. 4,131,205 to Malecki, which discloses two lower U-shaped rigid frame and two upper U-shaped rigid frames. The upper frames are so arranged that a plurality of hanging bars extend in the same horizontal plane, whereas the lower frames have a plurality of hanging bars spaced from one another in parallel vertical planes. This structure has a space between the upper and lower frames that cannot be filled with hanging bars without compromising the collapsibility of this drying rack.

A different design is disclosed in U.S. Pat. No. 4,807,766 to Compagnucci, discloses a drying rack having a plurality of U-shaped frames so interconnected with one another that the frames are displaceable between an unfolded position and collapsed positions in a rapid manner. Although this structure allows the frames to be opened or closed rapidly and easily, it is cumbersome in its collapsed position and, thus, requires a relatively large storage space.

The U.S. Pat. No. 4,828,123 discloses a collapsible clothes drying rack that includes a plurality of X-shaped frames pivotally connected to one another and extending in a vertical plane on top of one another. This structure also requires a substantial storage space in its folded position, and has spaces formed between adjacent frames that are not possible to fill with hanging bars without radically changing the original design.

What is desired, therefore, is an expandable and collapsible structure having an high capacity for holding hanging articles, for a relatively small footprint, and which is easy to open and close, and which is attractive in appearance.

SUMMARY OF THE INVENTION

It is an object of the invention to provide an expandable structure that overcomes some of the disadvantages of the discussed prior art.

It is a further object of the invention to provide an expandable structure capable of receiving an increased number of articles without compromising its structural rigidity and without increasing its overall outer dimensions.

Still another object of the invention is to provide an expandable structure which is easy to convert between an expanded position and an expanded position, in which the structure readily retracts to a highly compact configuration for storage.

Yet another object of the invention is to provide an expandable structure that selectively extends to a large configuration for supporting a great load of articles.

A further object of the invention is to provide an expandable structure, which is readily mounted on at least one upright support.

In accordance with the foregoing, an expandable structure of the present invention achieves the above formulated objectives by providing spaced hanging bars that extend between two side supports, each formed from a plurality of pairs of links. The links of each pair of links are pivotally connected at a pivot point located below a midpoint of the links. The ends of the links of each link are connected to the ends of adjacent links in a pair of links. Thus, each link has three pivot points spaced asymmetrically from one another. The overall structure thereby achieves an arched shape in its expanded position, but can be collapsed to a small rectangular package. The asymmetrical formation of pivot points allows the hanging bars connecting outer, inner and intermediate pivot points respectively to lie in substantially parallel arcuate planes in an expanded or expanded position. As a result of such structure, the number of hanging bars can be increased without, however, increasing the overall outer dimensions of the expandable structure. The pivot points are bridged by the hanging bars.

In one embodiment of the invention, the rack is adapted to be placed in the bathtub of a dwelling by providing one side of the pair of support legs with a U-shaped bracket. With a U-shaped mounting bracket, the user may mount the legs on one side of the rack on the bathtub's wall, and the other leg may be placed on the bottom of the tub or the lip of the tub opposite the side wall of the bathtub.

The above and other objects, features and advantages will become more readily apparent from the following description taken in conjunction with the following drawings.

BRIEF DESCRIPTION OF THE DRAWINGS

FIG. 6 is an exploded view of a pivot connection between elements of the expandable structure of FIG. 1.

FIGS. 7A and 7B are diagrammatic views of different embodiments of a mounting assembly attached to the expandable structure.

DETAILED DESCRIPTION OF THE DRAWINGS

Referring to FIGS. 1–4, an expandable structure, further referred to as a rack and generally designated 10, is shown as constructed in accordance with the principles of the invention. Specifically, the rack 10 is shaped and dimensioned to support various articles, for example, clothes, to facilitate air drying thereof. However, it should be understood that the rack 10 can be employed to just support and/or facilitate drying a wide variety of articles.

Figure 1:
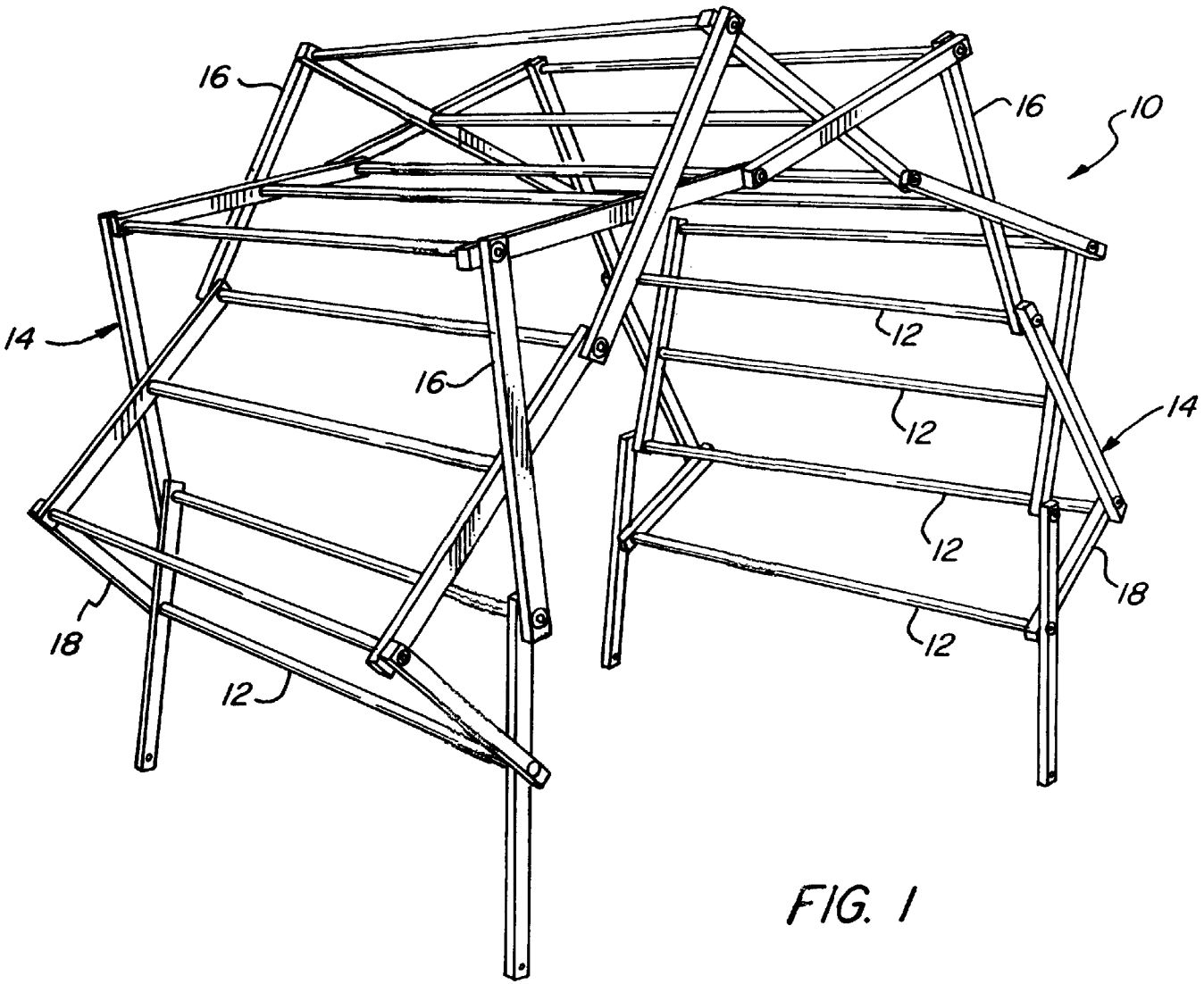
FIG. 1 is a perspective view of an expandable structure in accordance with the invention shown in a first expanded position.

Turning to FIG. 1, the rack 10 basically includes a plurality of hanging members 12 mounted between two side supports 14. The cross-sectional shape of hanging members 12 is preferably circular, but may be any other shape as desired, for example, annular or polygonal, as long as the functionality of these hanging members 12 is not compromised. The length of the hanging members 12 is selected so that the complete product is appropriately sized for the expected location of use. It is expected that a rack 10 that is to be used outdoors, for example, as a poolside towel drying rack, will be larger than a rack 10 that is to be used indoors in a bathroom. A typical length for the hanging members 12 will be 4 feet for an outdoor use, and 3 feet for an indoor use. Typically, as illustrated, the hanging members 12 will have a uniform length and diameter. If constructed from wood, a dowel having a diameter of ⅝ inches will preferably be used for the hanging members 12.

Figure 3:
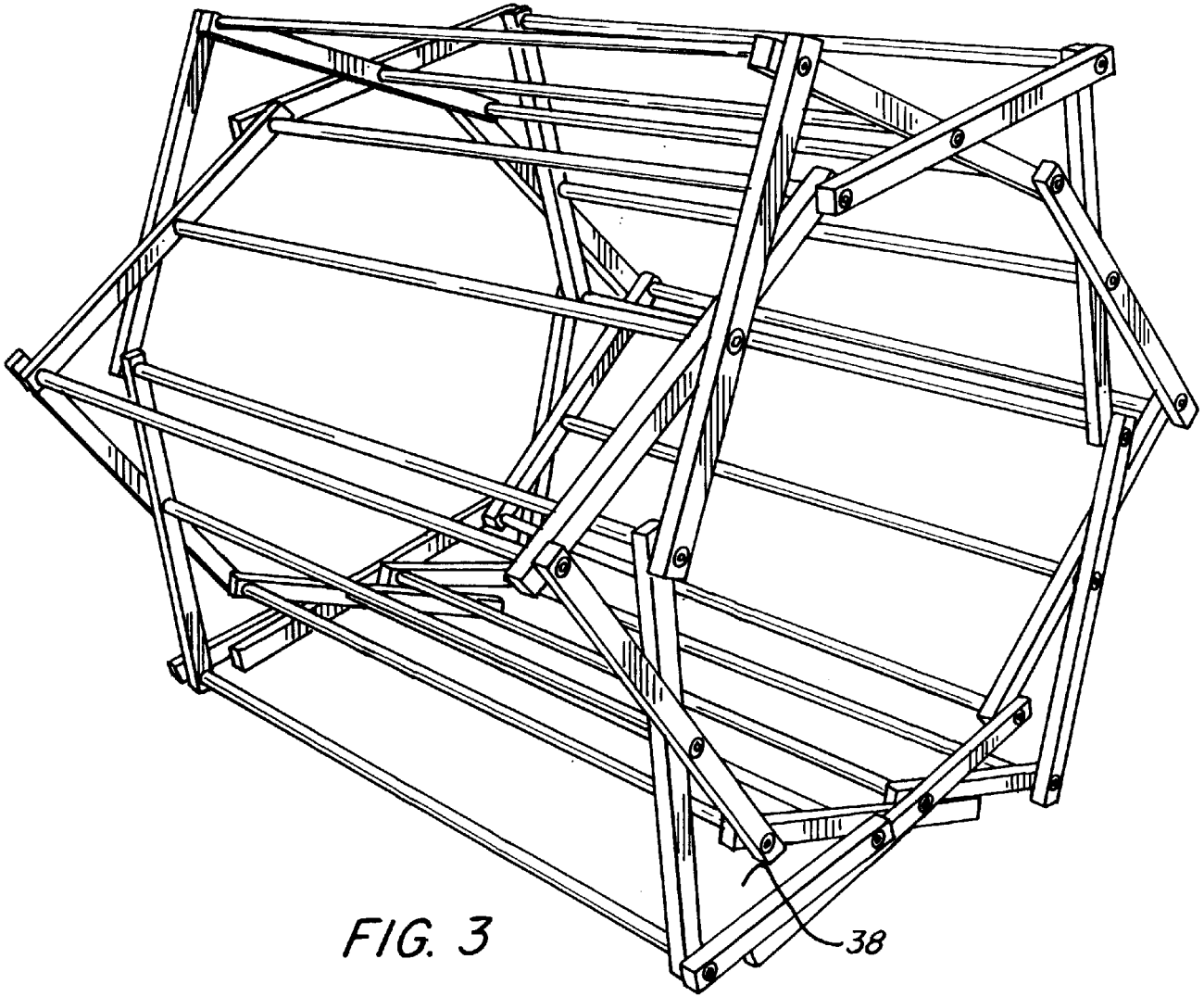
FIG. 3 is a perspective view of the expandable structure of FIG. 1 shown in a second expanded position.
Figure 4:
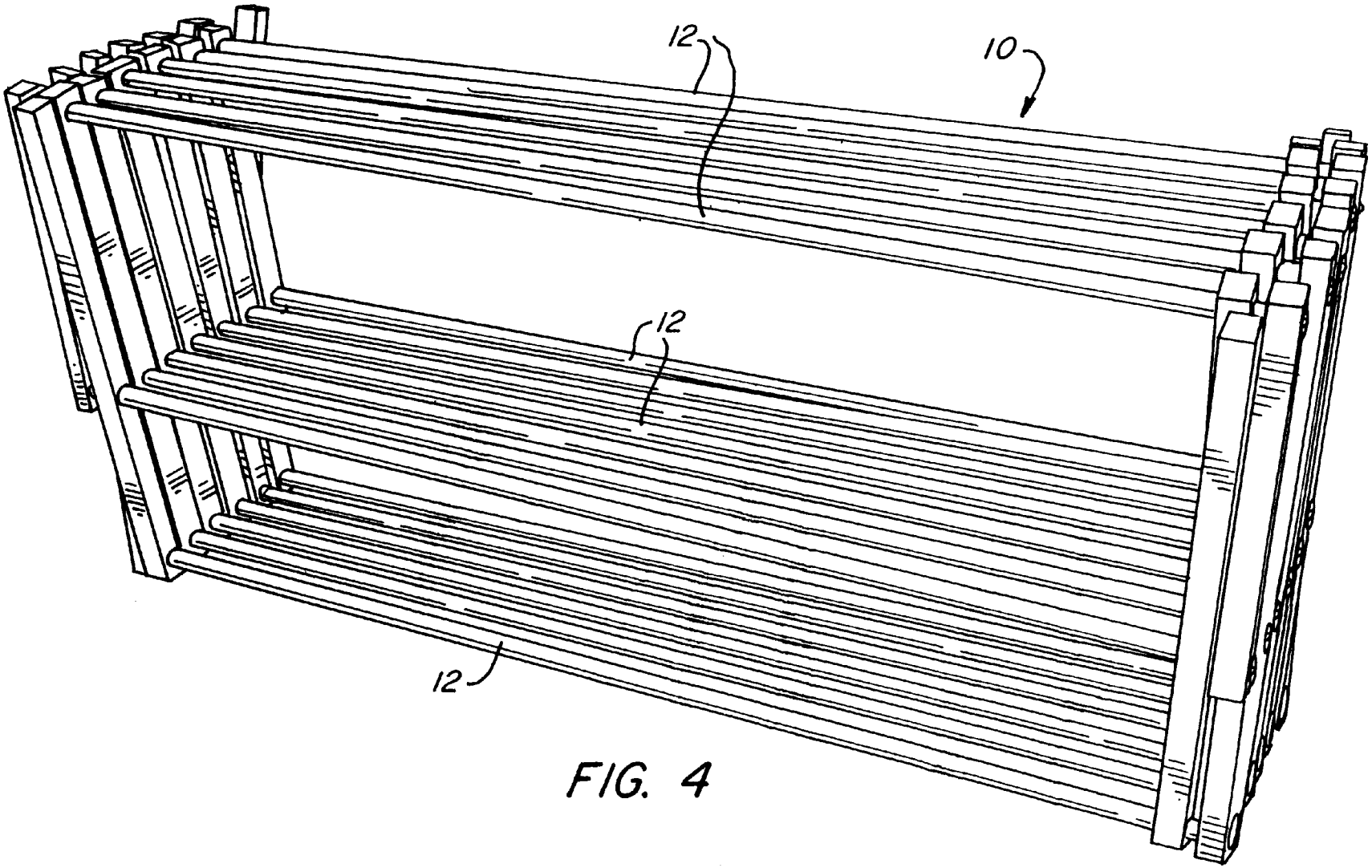
FIG. 4 is a perspective view of the expandable structure of FIG. 1 in a collapsed position.

The side supports 14 are each formed of a plurality of pivotally connected links 16 that are arranged to allow the rack 10 to convert between a collapsed position as shown in FIG. 4 to expanded positions as shown in FIGS. 1 and 3. As illustrated in FIG. 4, the collapsed position of the rack 10 is characterized by parallel hanging rods 12 forming three tiers thereof that lie in parallel straight planes spaced asymmetrically relative to one another for the reasons explained hereinbelow. In accordance with the inventive concept, the rack has a generally arcuate and or circular or partially circular shape upon converting to any of its expanded positions.

This is achieved by a combination of links 16 arranged as a plurality of pairs of links 16. Each link of said pairs of links is pivotally connected at a pivot point 20. The pivot points 20 are located below a midpoint of each link 16. The ends 21 of each link 16 in said pairs of links 16 are pivotally attached to an adjacent end 21 of a link 16 in an adjacent pair of links 16. The side supports are therefore expandable into an arcuate form such that rack 10 can be used, and collapsible into a flattened form such that rack 10 can be stored.

Figure 5A:
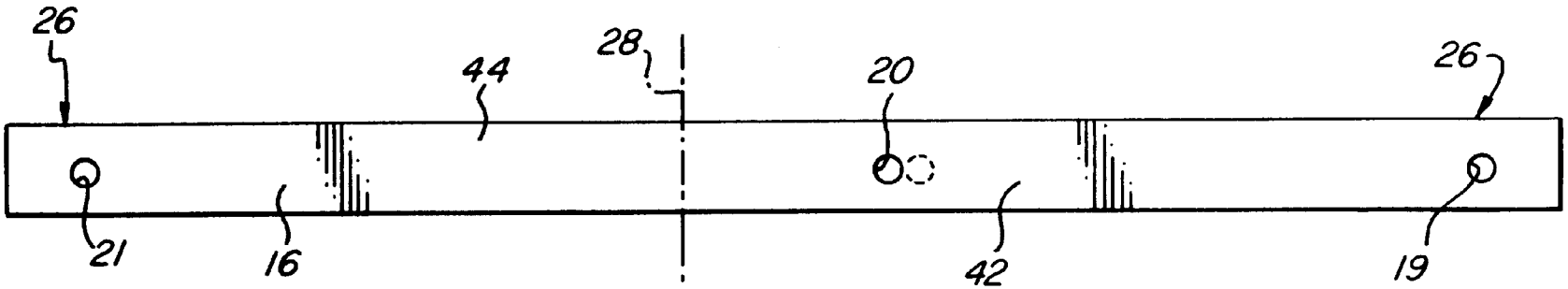
FIG. 5 is a diagrammatic view of links of the expandable structure shown in FIG. 1.
Figure 5B:
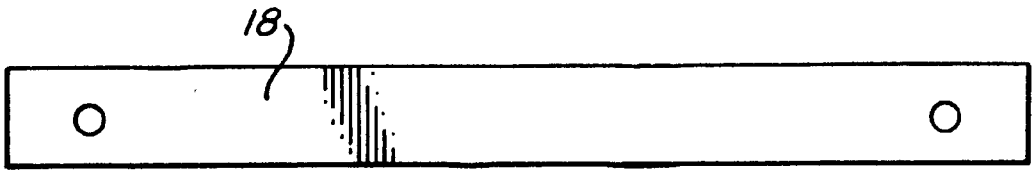

Each of the links 16, better seen in FIG. 5, is an elongated bar, preferably having a rectangular shape, and is provided with a multiple bore arrangement that includes three bores 19, 20 and 21. Where the links 16 are formed of wood, they may be 17 inches in length, with the bores 19 and 21 spaced about 1 inch inwardly from the ends of the links. The bore 20 is preferably located 8¾ inches from bore 21, and 6 1/12 inches from bore 19. Since the bores are spaced asymmetrically from one another, with upper end of the link (defined by the distance from bore 20 to bore 21) being longer than the lower end of the link 16 (defined by the distance from bore 20 to bore 19), the upper ends of the pairs of links have greater opening span than the lower ends, thereby forcing the rack 10 to form the arcuate position when the rack is expanded. Outer bores 19, 21 are formed at opposite end regions 26 of the link 16 and are spaced generally equidistantly from a link midpoint axis 28. An intermediate bore 20 is offset with respect to this midpoint axis 28. The bores preferably have a circular cross-sectional shape, to receive circular ends of the hanging members 12, but, as described below, the diameter of the bores may vary to create a shoulder within the bore to keep the elements aligned properly, as shown in FIG. 5 and explained in detail hereinbelow.

An end pair of links located at each end of the plurality of pairs of links of the side supports each comprise a full link 30 and a partial link 18. The partial link 18 extends between pivot point 32 and is pivotally connected to an adjacent end of a link 16 in an adjacent pair of links. Preferably, each of the partial links 18 is formed with bores spaced from one another at a distance corresponding to the largest distance between bores 19, 20, which are provided on the link 16. Full link 30 is pivotally connected at one end 34 to an adjacent end of a link 16 in an adjacent pair of links, and has a free end 34 which is unconnected to any other link.

Figure 2:
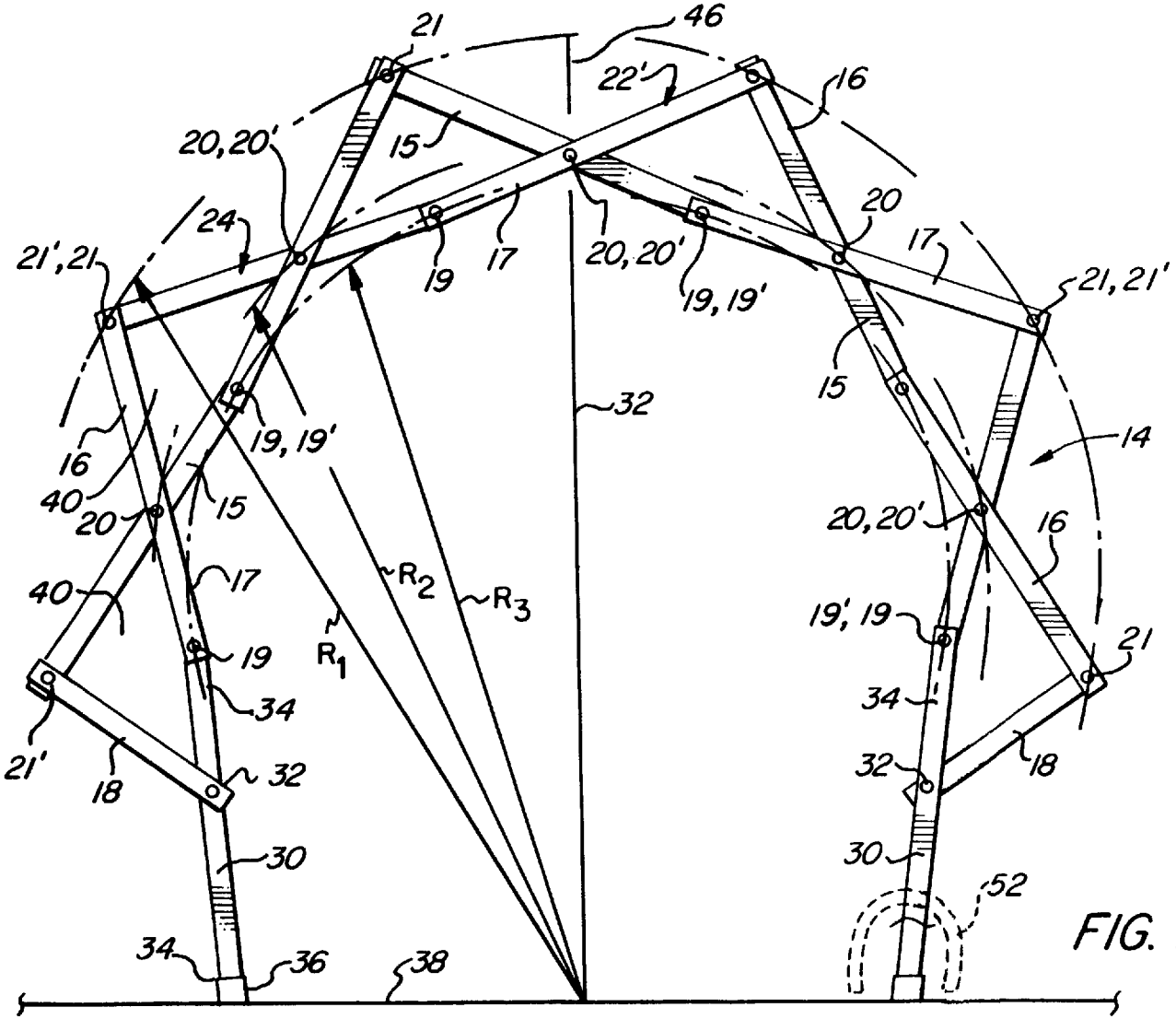
FIG. 2 is a side elevation view of the expandable structure of FIG. 1 shown in the first expanded position.

The expanded position of the rack 10 is represented by a generally symmetrical structure extending along an axis 32 and having support legs 30 that preferably have the same size as the rest of the links 16. The free ends 34 of legs 30 are provided with rubber caps, pads or covers 36 that enhance contact with a surface 38. As can be seen in FIG. 2, the support legs 36 extend substantially parallel to the axis 32 thereby defining the rack's largest state. The largest possible radii R1, R2 and R3 corresponding to concentric arcuate planes in which the outer bores 21, intermediate bores 20 and inner bores 19 of the outer links 17 lie respectively characterize this state.

Referring to FIG. 2, the side supports 14 of the invention may be alternatively defined as having a group of outer links 17, forming an outer frame 22, and a group of inner links 15 defining an inner frame 24. Each link of the outer and inner frames, are identical to the link 16 described above and shown in FIG. 5. Attaching the inner frame 24 of the links 15 to the outer links 17 completes the assembly of the support 14. According to the invention, each link of the inner and outer frames extends over a group of three neighboring links of the other frame and is interconnected therewith by respective hanging rods traversing coaxially positioned bores which are formed in these interconnected links. For example, the inner and outer bores 19, 21 of the outer link 17 are coaxial with the inner and outer bores 19', 21' of first and third inner links 15 respectively. At the same time, the intermediate bore 20 of the same outer link 17 is registered with an intermediate bore 20' of the second inner link 15.

This connection provides the rack 10 with a plurality of right triangles 40 in the expanded position shown in FIG. 2. It should be understood that in order to obtain the concentric planes, short and long portions 42, 44 (FIG. 5) of the inner links 15 overlap the short and long portions of the outer links 17 respectively.

Due to the arcuate shape of the rack in its expanded positions, the rods are spaced from one another at a distance sufficient to conveniently hang articles on neighboring rods while having the overall dimensions of the rack still suitable for a relatively small space. Displacing the support legs 30 with respect to one another, a user can adjust a desirable distance between an apex 46 of the rack and the support surface 38 so the rack can receive differently sized articles.

Referring to FIG. 3, another expanded position of the rack 10 is shown. As is mentioned above, one of the objects of the invention is to efficiently use a space required for a convenient use of the rack. This is achieved by displacing the support legs 30 from their vertical position of FIGS. 1 and 2 to an expanded position shown in FIG. 3. Particularly, based on the inventive concept, the rack is converted to a rounded state, in which the supports 14 are basically continuous and the rods 12 are arranged in concentric and generally circular planes. As a consequence, the distance between the apex 46 and the support surface 38 as well as the radii $R_1$, $R_3$ are substantially reduced thereby allowing the rack to be utilized in a relatively small space. The short distances between the bores 19, 20 and 19' and 20' respectively may be so selected, that the hanging rods connecting intermediate bores 20, 20' and the bores 19, 19' substantially lie in the same circular plane.

As has been mentioned above, FIG. 4 illustrates the collapsed position of the rack 10, wherein all of the links extend substantially in the same plane, preferably, a vertical plane, whereas the hanging rods form three parallel tiers lying in asymmetrically spaced parallel planes. Specifically, the inner and outer links extend in two vertical planes slightly inclined with respect to each other in the collapsed position of the rack, which can be easily converted to one of the expanded positions by pulling any pair of rods upwardly.

The example of the invention given herein provides a drying rack, which in its expanded position, has 19 hanging dowels providing 57 linear feet of space to hold a load of wash, or a double size quilt, or blanket, or other linens. The rack stands 51 inches wide by 47 inches high. When folded up, the drying rack collapses to a rectangle which is 2 feet by 3 feet by 12 inches deep.

As shown in FIG. 6, each of the hanging rods 12 is formed with opposite end regions 13 having their diameters reduced relative to an intermediate portion 11. The registered bores, for example bores 21' and 20 of the inner and outer links 15, 17 respectively, are traversed by the end region 13 that is pivotally attached to the outer link 17 by means of a washer 48 and a screw 50. Since the washer abuts the outer link 17, each of the rod's ends lies flush with an outer surface 52 of this link 17 thereby making the rack's appearance appealing to a user.

According to another aspect of the invention, the bores 19–21 and 19'–21' may have oblong shapes that allow a degree of adjustability of the rack 10 in its expanded positions. For example, FIG. 6 illustrates the intermediate bore 20 shown in dash lines and having a "Figure 8" shape that allows a user to displace a particular rod 12 between two annular compartments. As a result of such displacement, distances between the rods 12 and between the apex of the rack 10 and the supporting surface 38 (FIG. 1) respectively can be modified to accommodate articles having different sizes and shapes. It should be understood that shapes, sizes and planes, in which these oblong bores can extend, may vary according to a particular design without, however, substantially reducing the rigidity of the rack.

In accordance with still another aspect of the invention shown in FIG. 7, two of the support legs 30 are shorter than the other support legs and each of the short support legs has a U shape bracket 52 adapted to be mounted on an upright support. By shortening hanging rods 12, it is possible to utilize such design in an urban dwelling by simply positioning one pair of support legs 34 on the bathtub's bottom whereas the short support legs equipped with the mounting brackets are mounted on the bathtub's wall. Preferably the hanging rods 12 are telescopically extendable in a direction of arrow A, as is shown in FIG. 6. This structure can substantially facilitate length adjustment of the rack. It is conceivable to provide a unitary U-shaped bracket bridging the bottoms of the short support legs 30, as is illustrated by dashed lines in FIG. 7B.

Material used for manufacturing the rack may include wood, polymer or even light metal. Although the rack has been described primarily as a drying rack, it is possible to use it as a toy for children. It is apparent that various changes may be made to the rack without departing from the inventive scope, as defined by the following claims.

What is claimed is:

1. A foldable drying rack comprising:

a plurality of spaced apart parallel hanging bars; and side supports holding said hanging bars, said side supports each comprising a plurality of pairs of links, each link of said pairs of links being pivotally connected at a pivot point located below a midpoint of each link in said pairs of links, each end of each link in said pairs of links being pivotally attached to an adjacent end of a link in an adjacent pair of links; said side supports being expandable into an arcuate form such that said rack can be used in an expanded position wherein the hanging bars define at least two concentric annular planes, and being collapsible into a flattened form such that said rack can be stored.

2. A foldable drying rack in accordance with claim 1, wherein end pair of links located at each end of said plurality of pairs of links of said side supports each comprise a full link and a partial link, said partial link extending between said pivot point and an adjacent end of a link in an adjacent pair of links, said full link being coupled at one end to an adjacent end of a link in an adjacent pair of links and having a free end which is unconnected to any other link.

3. A foldable drying rack in accordance with claim 2, wherein said free ends of said full links are provided with a cushioning end cap.

4. A foldable drying rack in accordance with claim 2 wherein each of said hanging bars has a circular cross-section.

5. A foldable drying rack in accordance with claim 1 wherein pivot points at each end of each link are spaced equidistantly from said midpoint of said links, and said pivot point connecting the two links of each pair of links is offset from said midpoint.

6. A foldable drying rack in accordance with claim 1 wherein each pivot point includes a bore receiving an end portion of a hanging bar, and a retaining fastener attached to said end potion of said hanging bar at an outer end thereof to retain two links to said hanging bar.

7. A foldable drying rack in accordance with claim 6 wherein said end portions of said hanging bars have an outer dimension which is less than an outer dimension of an intermediate portion of said hanging bars extending between said end portions, and said end portions are received in said bores of said links.

8. A foldable drying rack in accordance with claim 2, wherein said free ends of said full links are provided with a U-shaped mounting bracket.

9. A foldable drying rack in accordance with claim 1 wherein the hanging bars define three concentric arcuate planes when said drying rack is in an expanded position.

10. A foldable drying rack in accordance with claim 1 wherein there are at least five of said pairs of links provided in each said side support.

11. A foldable drying rack in accordance with claim 2 wherein there are at least five of said pairs of links and two said end pairs of links provided in each said side support.

12. A foldable drying rack comprising:

a plurality of spaced apart parallel hanging bars; and side supports holding said hanging bars, said side supports each comprising a plurality of pairs of links, each link of said pairs of links being pivotally connected at a pivot point located below a midpoint of each link in said pairs of links, each end of each link in said pairs of links being pivotally attached to an adjacent end of a link in an adjacent pair of links; end pairs of links located at each end of said plurality of pairs of links of said side supports having a full link and a partial link, said partial link extending between said pivot point and an adjacent end of a link in an adjacent pair of links, said full link being coupled at one end to an adjacent end of a link in an adjacent pair of links and having a free end which is unconnected to any other link; said side supports being expandable into an arcuate form such that said rack can be used in an expanded position wherein the hanging bars define at least two concentric annular planes, and being collapsible into a flattened form such that said rack can be stored.

13. A foldable drying rack in accordance with claim 12, wherein said free ends of said full links are provided with a cushioning end cap.

14. A foldable drying rack in accordance with claim 12, wherein said free ends of said full links are provided with a U-shaped mounting bracket.

15. A foldable drying rack in accordance with claim 12 wherein each of said hanging bars is circular in cross-section, and has end portions having a lesser diameter than the diameter of a main body of said hanging bars, and wherein each pivot point includes bores formed in said links for receiving a said end portion of a hanging bar, and a retaining fastener attached to said end potion of said hanging bar at an outer end thereof to retain two links to said hanging bar.

16. An expandable structure comprising:

a plurality of spaced parallel members, each having opposite end portions;

a plurality of links forming an inner and outer frames operatively connected to each of the opposite end portions of said members, each link of one of the frames bridging three neighboring links of the other frame to define inner, intermediate and outer asymmetrically spaced apart overlapping regions of the interconnected links; and pivot assemblies formed in each of the inner, intermediate and outer overlapping regions and receiving the opposite end portions of the parallel members to convert the expandable structure from a collapsed position, wherein said members, received in the inner, intermediate and outer pivots, define three straight spaced parallel planes, to a series of expanded positions, in each of which the parallel members define three concentric annular planes.

* * * * *